United States Patent [19]

Davis et al.

[11] 4,066,128

[45] Jan. 3, 1978

[54] WELL FLOW CONTROL APPARATUS AND METHOD

[75] Inventors: Jerry B. Davis, Dallas; Guy W. Gant, Richardson, both of Tex.

[73] Assignee: Otis Engineering Corporation, Dallas, Tex.

[21] Appl. No.: 595,548

[22] Filed: July 14, 1975

[51] Int. Cl.[2] ..... E21B 23/02; E21B 43/12

[52] U.S. Cl. ..... 166/315; 166/117.5; 166/318; 166/332

[58] Field of Search ..... 166/117.5, 73, 224 R, 166/315, 313, 289, 318, 332

[56] References Cited

U.S. PATENT DOCUMENTS

| | | | |
|---|---|---|---|
| 2,828,698 | 4/1958 | Bryan | 166/117.5 X |
| 2,923,357 | 2/1960 | Daffin | 166/313 X |
| 2,970,648 | 2/1961 | Daffin et al. | 166/244 X |
| 3,054,415 | 9/1962 | Baker et al. | 166/224 X |
| 3,054,456 | 9/1962 | Hammaker | 166/224 |
| 3,059,700 | 10/1962 | Loy et al. | 166/224 |
| 3,378,068 | 4/1968 | Page, Jr. | 166/315 X |
| 3,493,052 | 2/1970 | Evans et al. | 166/315 |
| 3,603,393 | 9/1971 | Terral | 166/224 X |
| 3,653,435 | 4/1972 | Reistle et al. | 166/313 X |
| 3,802,503 | 4/1974 | McGinn | 166/117.5 |

*Primary Examiner*—Stephen J. Novosad
*Assistant Examiner*—George A. Suchfield
*Attorney, Agent, or Firm*—H. Mathews Garland

[57] ABSTRACT

A side-pocket mandrel for supporting a flow control device such as a gas lift valve along a well flow conductor and a method of operating same. The mandrel is connectible with pipe sections to form an integral length of a flow conductor and has a central bore communicating with the bore of the flow conductor, an orienting sleeve along an end portion of the mandrel, a side-pocket portion communicating with the main bore, a side-pocket landing nipple in the side pocket portion communicating with side ports in the mandrel along the landing nipple, a sliding sleeve valve disposed in the landing nipple for controlling communication through the side ports opening into the landing nipple, and a flow control device such as a gas lift valve releasably lockable in the sliding sleeve valve. The landing nipple and the sliding sleeve valve have locking recess and support and operating shoulder configurations whereby the sliding sleeve valve is moved to and locked at an open position when the flow control device is landed and locked in the landing nipple and the sliding sleeve valve is closed when the flow control device is removed from the landing nipple.

19 Claims, 12 Drawing Figures

WELL FLOW CONTROL APPARATUS AND METHOD

This invention relates to well tools and a method of operating same and more particularly relates to a flow control device support mandrel of the side-pocket type for use in a well flow conductor.

It has been standard practice in the past to use side-pocket mandrels having side-pocket landing nipples for supporting flow control devices such as gas lift valves in flow conductors of wells. The mandrels are spaced along the length of a flow conductor at appropriate depths in a well at which flow is desired between the annulus space around the flow conductor and the bore through the conductor. One specific use of such a well arrangement is where lift gas is used to produce oil in a well. The gas is, for example, introduced into the well through the annulus around the flow conductor, is admitted to the flow conductor through gas lift valves supported in the side pocket mandrels, and flows upwardly within the flow conductor to assist in lifting oil to the surface in the flow conductor. One such design of a side-pocket mandrel which has been employed in the past is iillustrated at page 4057 of the 1974–75 edition of the *Composite Catalog of Oilfield Equipment and Services* published by World Oil, Houston, Texas. The side-pocket mandrel illustrated in such reference together with other similar sidepocket mandrels which are known to have been used in the past include ports leading to the side pocket landing nipple which remain open between the annulus around the mandrel and the interior of the mandrel at times when a flow control device such as a gas lift valve is not installed in the side pocket landing nipple. Thus, during those times there is free communication between the flow conductor and the annulus through the sidepocket mandrel ports.

It is an object of the present invention to provide a new and improved mandrel for supporting a flow control device along a flow conductor in a well bore.

It is another object of the invention to provide a new and improved mandrel of the side-pocket type for use in a well flow conductor.

It is another object of the invention to provide a new and improved side-pocket mandrel which includes a sliding sleeve valve in the side-pocket landing nipple of the mandrel for controlling flow between the bore of a flow conductor and the annulus around the conductor.

It is another object of the invention to provide a side-pocket mandrel having a sliding sleeve valve in the side pocket landing nipple, which valve is opened and closed by the landing and retrieving, respectively, flow of a control device in the side pocket landing nipple whereby the sliding sleeve valve is opened when the flow control device is installed in the landing nipple and is closed when the flow control device is retrieved from the mandrel.

It is a still another object of the invention to provide a side-pocket type mandrel having a sliding sleeve valve in the side-pocket landing nipple of the mandrel and including an orienting sleeve within the mandrel spaced from the landing nipple for properly orienting a running tool and flow control device being installed and retrieved from the mandrel.

In accordance with the invention, a mandrel of the side-pocket type for use in a flow conductor of a well is provided including a mandrel body member connectible at opposite ends into a well flow conductor, such member having a central bore portion communicating with the flow conductor and an offset side-pocket bore portion along which a side-pocket landing nipple is formed within the mandrel communicating through the side wall of the mandrel through side ports provided therein. In accordance with particular features of the invention, a sliding sleeve valve is provided in the side-pocket landing nipple for control of communication through the side ports in the mandrel. The side-pocket landing nipple and sliding sleeve valve are provided with appropriate locking recesses and operating shoulder surfaces for moving the sliding sleeve valve from a closed to an open position upon the insertion of a flow control device, such as a gas lift valve, into the side-pocket landing nipple, and for moving the sliding sleeve valve from the open position back to a closed position when the flow control device is retrieved from the mandrel. The mandrel includes orienting sleeve means positioned in relation to the side-pocket landing nipple to guide a handling tool and flow control device supported thereon to a proper position of orientation for installation of the flow control device in the side-pocket landing nipple and for retrieval of the device therefrom.

The foregoing objects and advantages of the invention together with the specific details thereof will be better understood from the following detailed description taken in conjunction with the accompanying drawings wherein:

FIGS. 1A, 1B, and 1C taken together form a longitudinal view in section and elevation of a side-pocket mandrel embodying the features of the invention showing a flow control device in the side-pocket landing nipple holding the sliding sleeve valve in the nipple at an open position;

FIG. 2 is a view in section and elevation along the line 2—2 of FIG. 1B showing a pair of guide lugs for directing the flow control device into the side-pocket landing nipple;

FIGS. 3A and 3B taken together constitute an enlarged fragmentary view in section and elevation of the side-pocket landing nipple showing the sliding sleeve valves closed;

FIGS. 4A and 4B taken together constitute an enlarged longitudinal view in section of the flow control device and locking mandrel shown in FIG. 1B;

Figure 2:
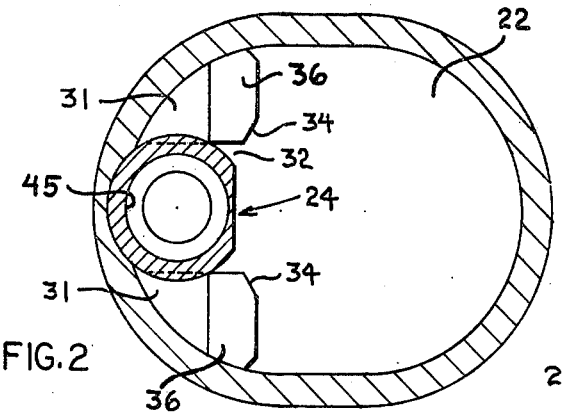
Figure 1A:
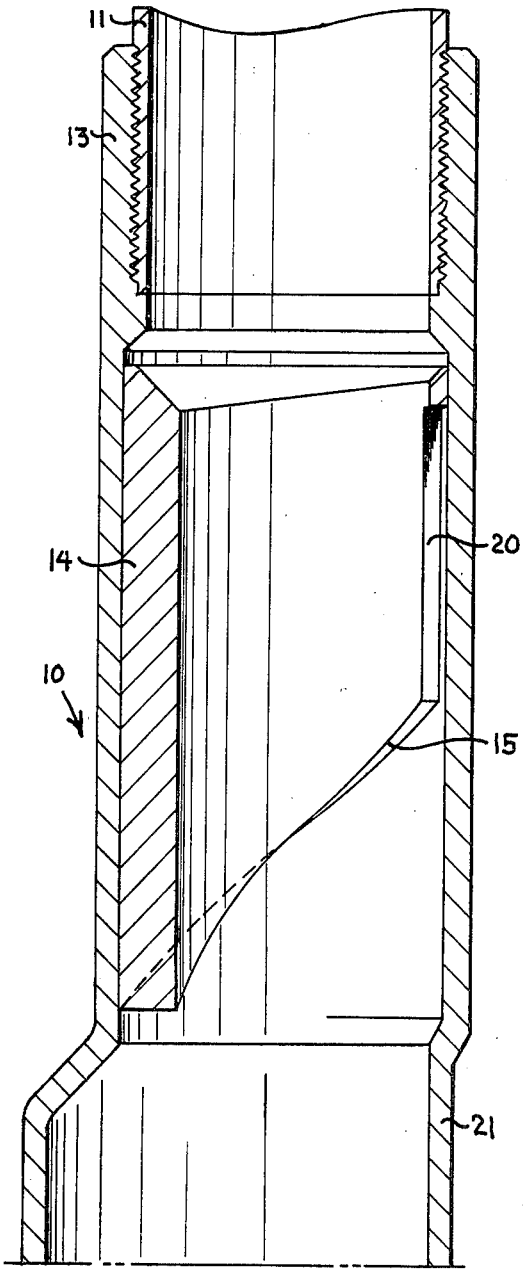
Figure 1B:
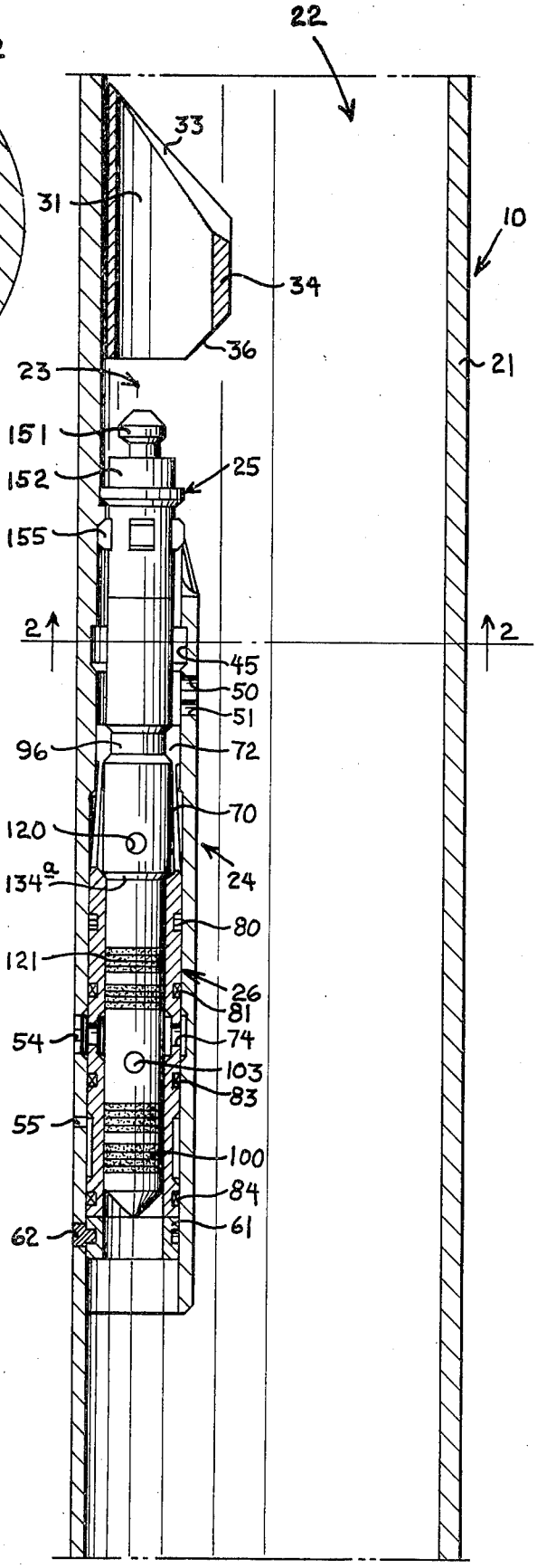
Figure 1C:
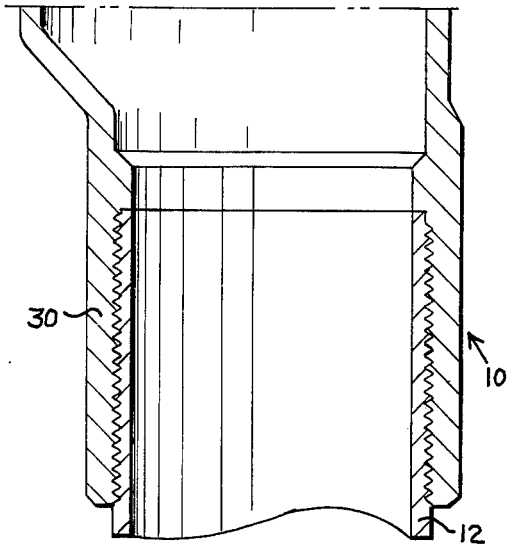
Figure 6:
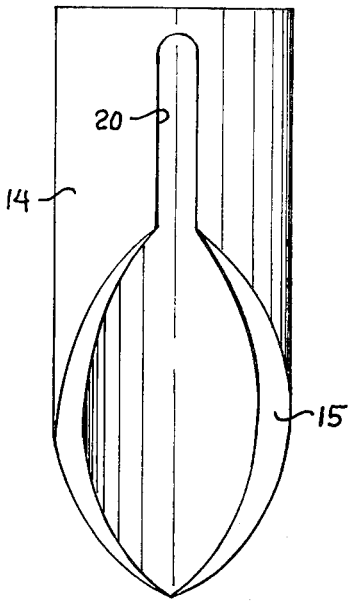
FIG. 6 is a side view in elevation of the guide shoe at the upper end of the side-pocket mandrel of FIG. 1A.

Referring to FIGS. 1A, 1B, and 1C, a side-pocket mandrel 10 embodying the features of the invention is connected in a flow conductor of a well which includes a tubing section 11 secured with the upper end of the mandrel and a tubing section 12 threaded into the lower end of the mandrel. The well flow conductor is typically a conduit which produces oil and gas and mixtures thereof from a well bore penetrating an earth formation. The mandrel 10 has an upper internally threaded box portion 13 which connects with the threaded lower end portion of the tubing section 11. The mandrel has a guide shoe 14 in the form of a sleeve provided with an internal upwardly sloping guide surface 15 which communicates with a longitudinal downwardly opening guide slot 20 for receiving a guide key or lug on a handling tool, not shown. The guide shoe is shown in FIG. 6 removed from the mandrel to clearly illustrate the features of the shoe. The mandrel includes an enlarged central portion 21 which as illustrated in FIG. 2 is oval in cross section to define a central bore portion 22 which communicates at opposite ends with the bores of the tubing sections 11 and 12, respectively. The enlarged central portion 21 of the mandrel also includes an eccentric side-pocket portion 23 to accommodate a side-pocket landing nipple 24 which supports a flow control device 25 which is illustrated as a gas lift valve for admitting gas from the space around the mandrel 10 into the bore through the mandrel. The device 25 is locked in a sliding sleeve valve 26 mounted in the side-pocket landing nipple. A lower end box portion 30 of the mandrel 10 as shown in FIG. 1C is internally threaded to receive the upper end portion of the tubing section 12 connecting the lower end of the mandrel into the flow conductor of a well.

Referring to FIG. 1B, the mandrel side-pocket portion 23 has a pair of guide lugs 31 spaced apart to define a guide slot 32 along the side pocket portion of the mandrel chamber to aid in directing the device 25 into the side-pocket landing nipple 24 during the procedure of installing the device 25 in the mandrel. The guide lugs 31 each have an upper guide surface 33 which slopes downwardly and inwardly toward the guide slot 32 joining a vertical guide surface 34 sloping inwardly toward the guide slot. The guide surfaces 33 and 34 aid in directing the flow control device 25 into the guide slot 32. Each of the lugs also has an upwardly and inwardly sloping lower end surface 36.

Figure 3A:
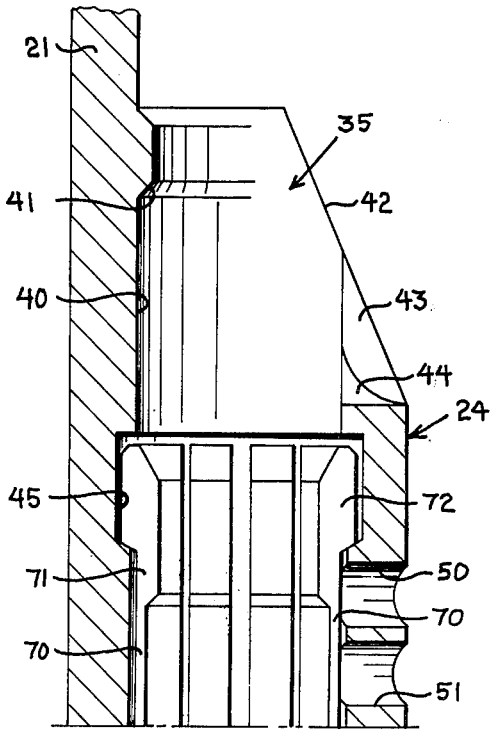
Figure 3B:
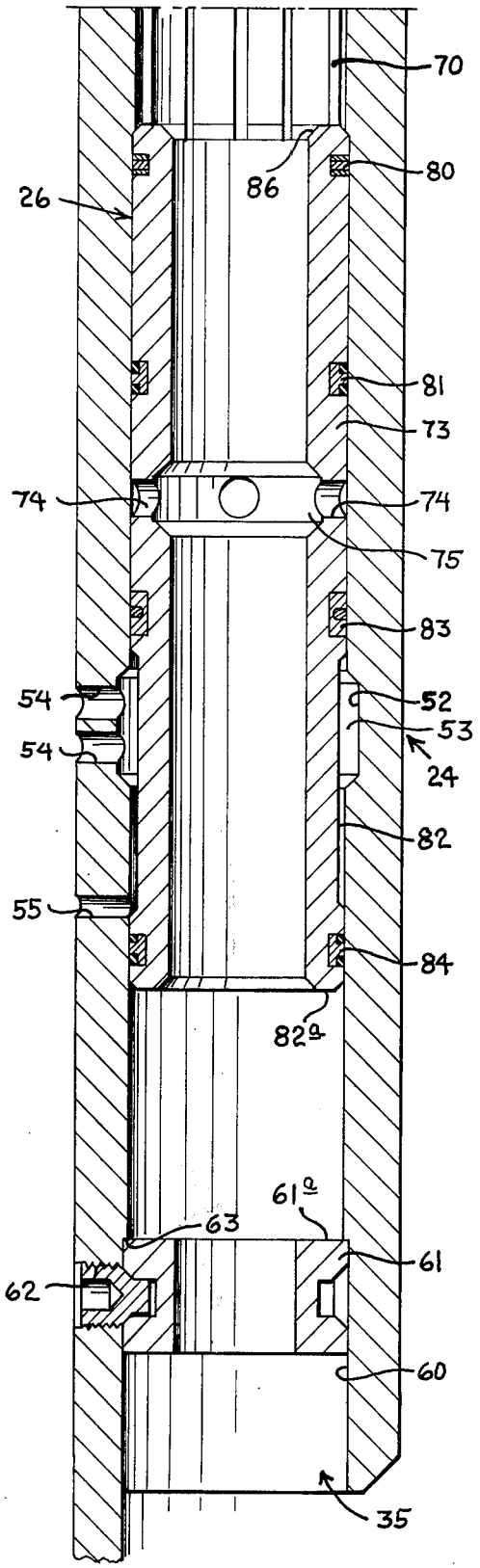

Referring to FIGS. 3A and 3B the side-pocket landing nipple 24 is a substantially cylindrical member formed integral with the side wall of the mandrel 10 along the eccentric side pocket 23. The landing nipple 24 has a central bore 35 to accommodate the flow control device 25. Referring to FIG. 3A, the bore 35 is enlarged along an upper end portion 40 defining a downwardly facing locking shoulder 41. The upper end of the landing nipple has a downwardly and inwardly sloping surface portion 42 adjoining a guide slot defined by surfaces 43 and 44 sloping into the bore 35 to further aid in guiding the flow control device 25 into the landing nipple. Below the bore portion 40, the landing nipple had an internal annular locking recess 45 for locking the sliding sleeve valve 26 at the upper closed position as shown in FIGS. 3A and 3B. Below the locking recess 45 the landing nipple 24 is provided with a pair of the flow ports 50 and 51 which communicate the bore of the landing nipple with the central bore of the mandrel 10. Referring to FIG. 3B, the side pocket landing nipple has an internal annular recess 52 defining an inlet flow passage 53 which communicates with a pair of spaced inlet side ports 54 in the side wall of the mandrel 10 to admit fluids into the side-pocket landing nipple from around the mandrel. The side wall of the mandrel 10 has another port 55 spaced below the port 54 to admit fluid from around the mandrel into the bore of the side pocket landing nipple around the sliding sleeve valve. The lower end portion of the bore 35 of the landing nipple is counterbored at 60 to accommodate a stop ring 61 held by a set screw 62 threaded through the side wall of the mandrel. The stop ring 61 is held against a stop shoulder 63 defined at the upper end of the counterbore portion 60 of the landing nipple bore. The stop ring 61 limits downward movement of the sliding sleeve valve 26.

The sliding sleeve valve 26 as shown in FIGS. 3A and 3B is a cylindrical open ended member having a plurality of upwardly extending circumferentially spaced locking collet fingers 70 each of which has a head portion 71 provided with a locking oss 72 engageable with the locking recess 45 of the side pocket landing nipple 24. The collet fingers are sufficiently flexible to compress inwardly for moving into the bore 35 of the landing nipple below the locking recess when the sleeve valve moves to the lower end open position. The sleeve valve has a lower central portion 73 having circumferentially spaced centrally located inlet ports 74 which open into an internal annular recess 75 to distribute incoming fluid around the interior of the sleeve to admit the fluid to the flow control device 25. Above the ports 74 the sleeve valve 26 is provided with a pair of spaced external annular ring seal assemblies 80 and 81. Below the ports 74 the sleeve valve has a reduced external annular portion 82 above and below which the sleeve valve has external annular seal assemblies 83 and 84 for sealing between the sleeve valve and the bore wall surface of the side-pocket landing nipple. The sliding sleeve valve 26 is movable between the upper closed position at which it is locked by the collet finger heads 72 as shown in FIGS. 3A and 3B to the lower open position illustrated in FIG. 1B at which the lower end of the sleeve valve engages the stop ring 61 limiting downward travel of the valve.

Figure 4A:
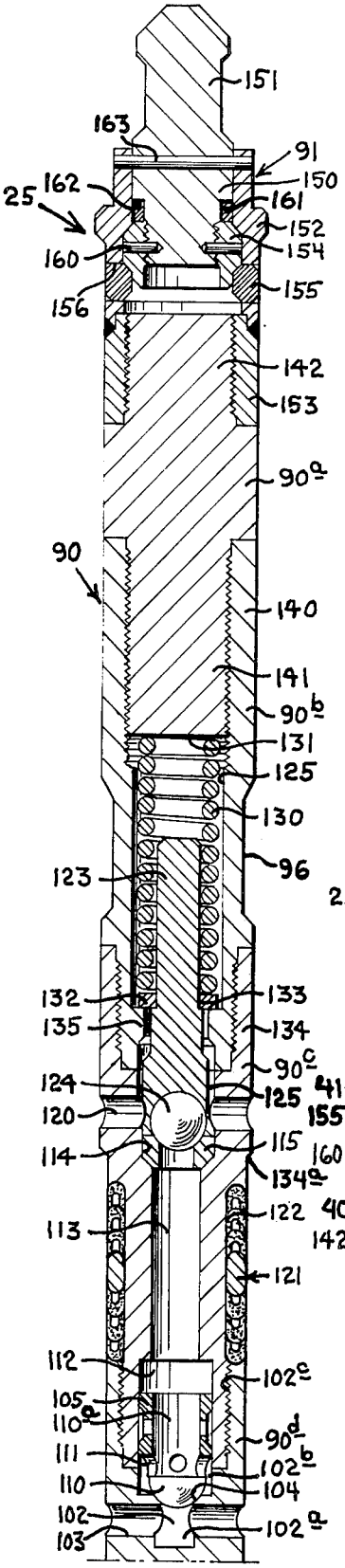
Figure 4B:
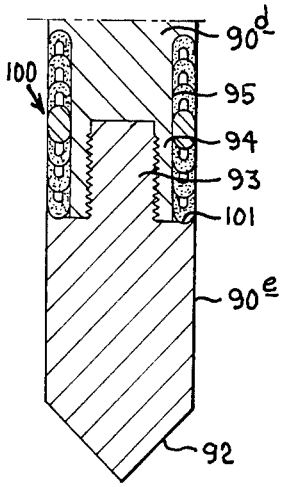

The flow control device 25 as illustrated in FIGS. 1B, 4A, and 4B is a gas lift valve used in the production of a well by a procedure which includes steps of injecting gas into an annulus of a well bore around a tubing string and inwardly into the tubing string through the device 25 when locked in the mandrel 10 as shown in FIG. 1B for the purpose of assisting in raising well fluids such as oil to the surface through the flow conductor forming the tubing string. The device 25 includes a body 90 formed by interconnected body sections **90*a*, 90*b*, 90*c*, 90*d*, and 90*e* as illustrated in FIGS. 4A and 4B. A locking manrel assembly 91 is secured on the body section 90*a* for releasably locking the flow control device within the side-pocket landing nipple 24. Referring to FIG. 4B, the lower end section 90*d* of the flow control device has a tapered or pointed lower end 92 for guiding the device into the landing nipple through the guide sleeve 14 and guide lugs 31 which direct the device to the proper location in the mandrel. The section 90*e* is reduced and externally threaded along an upper end portion 93 which engages a reduced and internally threaded counterbored lower end portion 94 of the section 90*d*. The section 90*d* has an external annular downwardly opening recess 95 which receives an extended annular seal assembly 100 for sealing around the flow control device within the sliding sleeve valve. An external annular stop shoulder 101 on the body section 90*e* supports the lower end of the seal assembly 100 and limits the threading of the section 90*e* into the section 90*d*. The flow control device section 90*d* has an upwardly opening counterbore 102 which is graduated in three stepped sections 102*a*, 102*b*, and 102*c*. Circumferentially spaced lateral ports 103 are provided in the section 90*d* opening into the lower end portion 102*a* of the counterbore 102 for flow of fluids into the flow control device. An annular valve seat 104 is defined along and around the counterbore 102 between the sections 102***a* and 102*b* above the ports 103. A check valve 105 is slidably disposed in the counterbore 102 permitting upward flow in the device 25 while precluding downward flow. The valve 105 has a valve head 110 which engages the seat 104 to preclude downward flow in the counterbore thereby providing the check valve function. The check valve 105 has a central upwardly opening counterbore 110*a* and a plurality of side ports 111 at the lower end of the counterbore permitting flow through the check valve when the valve is at an upper position spaced from the seat 104. The check valve 105 is slidable in a downwardly opening counterbore 112 in the lower end portion of the section 90*c* of the flow control device. The counterbore 112 communicates with a central bore 113 in the section 90*c* which is enlarged at 114 to receive an annular valve seat 115. A plurality of circumferentially spaced side ports 120 are formed in the section 90*c* communicating with the bore section 114 for discharging fluid from the device 25.

Fluid flows into the flow control device 25 at the ports 103, upwardly through the bores of the sections 90*c* and 90*d* past the check valve 105, and exits from the device through the ports 120. An external annular seal assembly 121 is supported within an external annular recess 122 formed along the section 90*c* extending to an upper end edge of the section 90*d* which holds the seal assembly in the recess 122. A valve member 123 having a ball shaped end insert 124 is positioned within the bore of the section 90*c* of the flow control device and the bore 125 of the section 90*b*. The valve member 123 is movable between a closed position engaging the valve seat 115 and an upper position at which the ball shaped insert 124 is spaced above the valve seat 115 to permit upward flow through the valve seat outwardly through the ports 120. The valve member 123 is biased downwardly by a spring 130 confined between a lower end 131 of the body section 90*a* and a retainer ring 132 supported on a stop shoulder 133 provided around the valve member 123. As seen in FIG. 4A, the internally threaded upper end section 134 of the body section 90*c* threads on a reduced lower end pin portion 135 of the body section 90*b*. Similarly an internally threaded upper end portion 140 of the body section 90*b* threads on the externally threaded lower end portion 141 of the body section 90*a*. The body section 90*a* has an externally threaded upper end pin section 142 on which the locking dog assembly 91 is secured.

Figure 5:
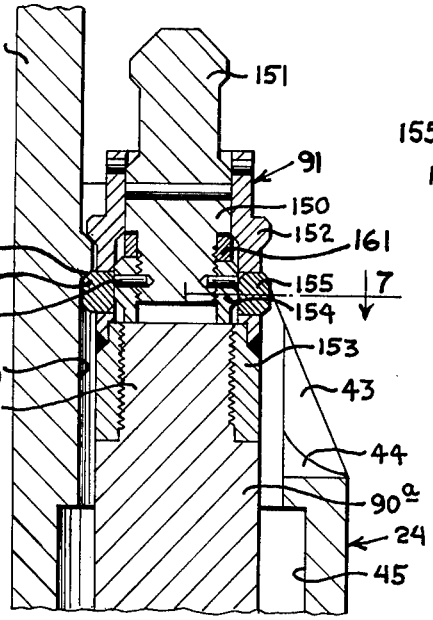
FIG. 5 is a fragmentary longitudinal view in section showing the upper ends of the side pocket landing nipple and the locking mandrel assembly on the flow control device in a locked relationship with the side-pocket landing nipple when the flow control device is installed in the landing nipple and the sliding sleeve valve is open.
Figure 7:
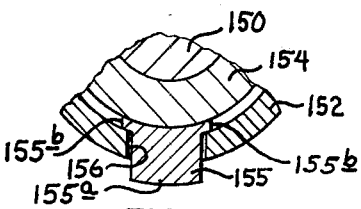
FIG. 7 is a fragmentary view in section of the locking mandrel assembly on the flow control device taken along the line 7 of FIG. 5.
Figure 8:
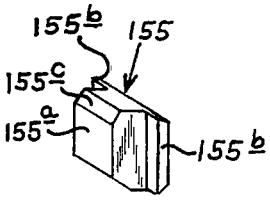
FIG. 8 is a view in perspective of one of the locking dogs of the flow control device locking mandrel of FIG. 5.

The locking dog assembly 91 of the flow control device 25 includes a central core or body 150 which has a fishing neck upper end section 151, a sleeve 152, a connector 153, a nut 154 and a plurality of locking dogs 155. The sleeve 152 is welded on the connector 153 which threads on the upper threaded pin portion 142 of the body section 90*a* of the flow control device 25. The nut 154 threads on the lower end of the body 150 held by roll pins 160. A friction ring 161 is positioned in a recess 162 around the body 150 held by the upper end edge of the nut 154. The sleeve 152 is held at a position on the body 150 by a shear pin 163 at which the dogs 155 are retracted as shown in FIG. 4A. The dogs 155 fit in windows 156 in the sleeve 152 for expansion and contraction between release positions as shown in FIG. 4A and expanded locking positions as shown in FIG. 5. The configurations of the dogs 155 and the windows 156 provide sufficient interference between the dogs and the windows at the expanded positions of the dogs as shown in FIG. 5 to prevent the dogs from coming out of the windows. Referring to FIGS. 7 and 8, each of the locking dogs 155 has an outer locking boss portion 155*a* which projects outwardly through the window 156 in which the dog is positioned for engagement with the locking shoulder 41 when the dogs are expanded as illustrated in FIG. 5. Each of the dogs 155 has laterally extending longitudinal locking flanges 155*b* which engage the inside wall surface of the sleeve 152 on either side of the window 156 for retaining the locking dogs in the windows when expanded at locking positions.

In the use of the present invention in a well bore the well is fitted with a tubing string which includes spaced side-pocket mandrels 10 located along the length of the string at desired depths in the well at which lift gas is to be injected for producing the well through the tubing string. As the tubing string is made up and lowered into the well, the side-pocket mandrels are included between adjacent ends of adjacent tubing string sections 11 and 12 as represented in FIGS. 1A and 1C. In order to insure that the ports 54 into the side-pockets of the mandrels are closed as the string is lowered into the well bore, the sleeve valve 26 in each of the side-pocket mandrels is located at an upper end position as each of the mandrels is connected in tubing string. The sleeve valve is readily closed by reaching into the mandrel to the side-pocket landing nipple with any suitable tool to engage the locking heads 72 on the collet fingers 70 for positioning the collet heads in the locking recess 45 as shown in FIG. 3A. At this upper end position of the sleeve valve the reduced lower end portion of the sleeve valve extends along the ports 54 and 55 so that the ring seals 83 and 84 are positioned above and below the ports respectively spanning the ports so that no inward flow may occur into the landing nipple through the ports. The tubing string with the side-pocket mandrels having the sliding sleeve valves at closed positions is run into the well bore in the usual manner.

When the well bore is to be converted to a gas lift system by the installation of the gas lift valves 25 in the side-pocket mandrels each of the gas lift valves is installed in the desired side-pocket mandrel by use of a suitable kickover tool supported on a suitable wire line on which it is run into the well bore in the tubing string. One such kick-over tool which may be used is described and illustrated in U.S. Pat. No. 3,827,490. The gas lift valve is connected by means of the locking mandrel assembly 91 at the upper end of the valve with the kick-over tool which is lowered on the wire line downwardly through the tubing string into the desired side-pocket mandrel at which a guide lug on the kick-over tool is lowered through the guide member 14 until the lug is below the guide surface 15 around the lower end of the guide member. The kick-over tool is then lifted upwardly so that the guide lug on the tool engages the guide surface 15 rotating the tool until the guide lug enters the downwardly opening orientation slot 20 which properly positions the gas lift valve 25 for lateral movement by the kick-over tool into the side-pocket portion 23 of the mandrel so that the valve may be lowered into the side-pocket landing nipple 24. As the kick-over tool shifts the gas lift valve into the side-pocket portion of the locking mandrel and lowers the valve toward the landing nipple the lower end surface 92 of the valve body is guided by the guide lugs 31 above the landing nipple into the guide slot 32 which properly aligns the gas lift valve for lowering into the bore of the landing nipple. The guide surfaces 33 along the upper end portion of the guide lugs and the longitudinal inwardly facing guide surfaces 34 smoothly direct the valve into the guide slot. Similarly the upper end surfaces 43 and 44 along the portion 42 of the landing nipple assist in directing the gas lift valve into the bore 35 of the landing nipple.

The gas lift valve 25 is lowered by the kick-over tool into the bore 35 of the side-pocket landing nipple 26 with the valve body moving downwardly in the landing nipple bore into the bore of the sliding sleeve valve 26 until the stop shoulder 134*a* on the valve central portion 90*c* engages the stop shoulder 86 within the sliding sleeve valve immediately below the collet fingers 70 of the valve. At this position of the gas lift valve in the sliding sleeve valve, the locking bosses 72 on the heads of the collet fingers 70 along the upper end of the sleeve valve are aligned with the external annular recess 96 along the gas lift valve body portion 90*b*. With the gas lift valve seated in the sliding sleeve valve the lift valve is driven downwardly applying a downward force on the sleeve valve so that the locking bosses 72 of the sleeve valve are cammed inwardly around the recess 96 on the gas lift valve body out of side-pocket landing nipple 45. The sliding sleeve valve is thereby released for a downward movement in the side-pocket landing nipple so that the downwardly moving gas lift valve forces the sliding sleeve valve downwardly with the inwardly compressed collet fingers 70 on the sleeve valve moving downwardly in the bore 35 of the side-pocket landing nipple below the locking recess 45 of the landing nipple. The sleeve valve moves downwardly until the lower end edge 82*a* of the sleeve valve engages the upper end surface 61*a* of the lock ring 61 as shown in FIGS. 1B and 3B.

When the sliding sleeve valve 26 engages the stop ring 61 the sleeve valve is at the open position at which the side ports 54 in the side-pocket mandrel landing nipple are aligned between the seals 81 and 83 on the sliding sleeve valve in the side-pocket landing nipple so that fluid may flow inwardly from the annulus around the tubing string through the side ports 54 into the annular space 53 around the ports to the inlet ports 74 of the sliding sleeve valve. At this open position of the sliding sleeve valve at which the gas lift valve is fully seated in the sleeve valve the locking dogs 155 on the locking mandrel 91 at the upper end of the gas lift valve are within the side-pocket landing nipple bore portion 40 below the locking shoulder 41 as best illustrated in FIG. 3A and FIG. 1B. The kickover running tool is then operated by means of the wire line to apply a downward force on the fishing neck 151 shearing the pin 163 releasing the fishing neck for downward movement. The fishing neck is driven downwardly farther into the sleeve 152 forcing the expander nut 154 downwardly within the locking dogs 155. The locking dogs are cammed outwardly by the tapered lower end surface of the expander nut until the locking dogs are expanded radially to the positions represented by FIG. 7 at which the outer locking boss portions 155*a* of the locking dogs are fully expanded into the bore portion 40 of the landing nipple 24. The tapered upper end surfaces 155*c* of the locking dogs are wedged against the locking shoulder 41 within the landing nipple. Since the sliding sleeve valve is at a lower end position and the gas lift valve is seated in the sleeve valve against the shoulder 86 of the sleeve valve, the wedging of the locking dogs against the landing nipple shoulder 41 tightly locks the gas lift valve in the landing nipple with the sliding sleeve valve open. The locking mandrel 91 on the gas lift valve is shown in locked relationship within the landing nipple in FIG. 5.

With the gas lift valve 25 properly landed and locked in the open sliding sleeve valve 26 lift gas may flow inwardly into the side-pocket landing nipple through the side ports 54 in the mandrel 10 to the annular space 53 around the entry ports 103 of the gas lift valve. The entering gas raises the check valve 105 so that the valve head 110 on the check valve is lifted from the seat 104. Lift gas flows upwardly around the valve head 110 into the bore of the check valve through the side ports 111. The upwardly flowing gas enters the bore 113 of the gas lift valve raising the ball valve member 124 which forces the valve stem member 123 upwardly compressing the spring 130. The valve member 124 is lifted from the seat member 115 allowing the lift gas to flow upwardly and outwardly through the side exit ports 120 and the valve body. The gas flows outwardly around the valve body between the collet fingers 70 and outwardly from the side-pocket landing nipple in the ports 50 and 51 entering the side-pocket mandrel main bore through which the lift gas flows upwardly in the tubing string to raise oil in the string to the surface. So long as the gas lift valve is in place it will function to open and close in the usual manner for admitting lift gas to the tubing string as needed for producing by gas lift in the usual manner.

When removal of the gas lift valves 225 from the side-pocket mandrels is desired a suitable pulling tool is used with the kick-over tool to enter the mandrel, engage the gas lift valve, and retrieve the valve from the side-pocket landing nipple. The fishing neck 151 is engaged by the pulling tool and forced upwardly lifting the expander nut 154 from within the locking dogs 155. When the expander nut moves above the locking dogs further upward force on the fishing neck lifts the sleeve 152 applying an upward force to the lower ends of the locking dogs through the bottom window surfaces in the sleeve. The upward force on the locking dogs against the locking shoulder 41 in the side-pocket landing nipple compresses the locking dogs inwardly releasing the locking mandrel 90 from the side-pocket landing nipple. As the gas lift valve is lifted the engagement of the collet finger head bosses 72 on the upper end of the sliding sleeve valve 26 forces the sliding sleeve valve upwardly until the locking bosses are aligned with the internal annular locking recess 45 in the side-pocket landing nipple. When the collet finger bosses are so aligned with the locking recess the collet fingers 70 expand outwardly locking the sliding sleeve valve 26 at the upper closed position at which the valve is returned to the upper end location shown in FIG. 3B. The outward movement of the collet finger bosses 72 into the recess 45 engages the sliding sleeve valve of the side-pocket landing nipple at the upper open position and the expansion of the collet fingers on the sliding sleeve valve radially outwardly from the locking recess 96 along the gas lift valve body releases the gas lift valve for removal from the sliding sleeve valve in the side-pocket landing nipple. Continued upward force of the fishing neck 151 by the handling tool lifts the gas lift valve upwardly removing the valve from the side-pocket landing nipple leaving the sliding sleeve valve locked up in the closed position. The kick-over tool moves the gas lift valve laterally into the main bore of the side-pocket mandrel from which it is lifted upwardly through the tubing string for removal from the well bore at the surface end of the tubing string.

It will be recognized that the side-pocket mandrel with the sliding sleeve valve in the side-pocket landing nipple of the invention provides apparatus and for a method of well operation wherein a tubing string may be fitted to perform a gas lift function and other possible functions in a well operation for selective communication between the well bore annulus and the tubing string when a desired control valve is installed in the side-pocket landing nipple of the mandrel. It will be recognized that while the valve which has been disclosed and described is for gas lift use other valves may be used in the side-pocket mandrel for controlling flow between the tubing string and the annulus around the tubing string. For example, if flow is desired into the annulus from the tubing string for well treatment purposes such as injecting a fluid into a formation, circulation of fluids from the annulus back to the surface along the annulus, and the like, a flow control valve may be installed in the side-pocket landing nipple to permit fluid flow into the annulus from the tubing string. Such flow control devices may be installed and retrieved by standard wireline methods and pumpdown techniques in which fluid flow is used to displace well tools from the surface to and from the side-pocket mandrel. The sliding sleeve valve in the side-pocket mandrel is particularly adapted to being opened and closed by the particular flow control device installed or retrieved without the need for additional steps for opening and closing the valve. The flow control device used in the side-pocket mandrel cooperates with the sliding sleeve valve locking mechanism in such a way that the control valve cannot be inserted without opening the sleeve valve and subsequently cannot be removed without returning and locking the sleeve valve at the closed position. Such features not only provide for the positive operation of the sliding sleeve valve but also give a means whereby the functioning of the valve can be monitored from the surface. For example, the wedging of the sleeve valve open for some reason such as undue trash in the well bore and the like would prevent the removal of the flow control device clearly indicating at the surface that some malfunction of the sliding sleeve valve had occured. Similarly an inability to open the sliding sleeve valve and lock the flow control device within the side-pocket landing nipple and the sleeve valve would indicate at the surface a malfunction of the sleeve valve.

What is claimed is:

1. A well device for controlling fluid communication between the interior and exterior of a well tubing comprising: a side-pocket mandrel body having means at each end for connection into said tubing and a longitudinal open bore for alignment with the bore of said tubing when said mandrel body is connected into said tubing; said mandrel body having a side-pocket chamber longitudinally aligned with and laterally offset from said open bore and communicating with said open bore; a side-pocket landing nipple formed in said side-pocket chamber for supporting a well tool in said mandrel body; said mandrel body having port means in a side wall thereof opening into said side-pocket landing nipple; and valve means secured in said landing nipple for opening and closing said port means into said nipple responsive to insertion and removal of a well tool in said nipple.

2. A well device in accordance with claim 1 wherein said valve means in said side-pocket landing nipple is a sliding sleeve valve.

3. A well device in accordance with claim 2 wherein said sleeve valve includes means for opening said valve and means for closing said valve responsive to the installation of a well tool in and removal of said tool from said side-pocket landing nipple.

4. A well device in accordance with claim 3 wherein said sliding sleeve valve includes locking means for releasably locking said sleeve valve at a closed position in said landing nipple.

5. A well device in accordance with claim 4 wherein said sliding sleeve valve is provided with an internal support shoulder for supporting a well tool therein and said landing nipple includes stop means for limiting movement of said sliding sleeve valve at an open position.

6. A well device in accordance with claim 5 wherein said side-pocket landing nipple includes a locking surface spaced from said sliding sleeve valve for engagement by a locking means on a well tool positioned in said sliding sleeve valve and said landing nipple for holding said sliding sleeve valve open when said well tool is in operating position within said landing nipple.

7. A well device in accordance with claim 6 wherein said releasable locking means on said sliding sleeve valve comprises a locking collet having radially movable collet fingers provided with locking heads adapted to engage a locking recess in said landing nipple when a well tool is not present in said sleeve valve and to move from said locking recess to interlock with a well tool when said tool is in operating position in said sliding sleeve valve.

8. A well device in accordance with claim 7 including laterally spaced guide lugs in said side-pocket chamber of said body mandrel longitudinally spaced from said side-pocket landing nipple to guide a well tool along said side-pocket chamber into said landing nipple and an orientation sleeve in said body mandrel aligned with said open bore and having an orientation slot and guide surfaces leading to said slot for manipulating a kick-over tool to orient said tool for insertion of a well tool supported by said kick-over tool into said side-pocket landing nipple.

9. A well device in accordance with claim 7 in combination with a well tool having a support shoulder for engagement with said sliding sleeve valve to move said valve from a closed to an open position and support said well tool in said valve, a recess in the body of said well tool for receiving the locking heads of said locking collet when said sliding sleeve valve is moved from a closed to an open position, and locking mandrel means for engaging said locking surface in said side-pocket landing nipple when said well tool is installed in said landing nipple.

10. A well device in accordance with claim 1 wherein said mandrel body is provided with laterally spaced guide lugs in said side-pocket chamber longitudinally spaced from said side-pocket landing nipple.

11. A well device in accordance with claim 10 wherein said body mandrel includes a sleeve concentric with said open bore and having guide surfaces and an orientation slot to coact with a kick-over tool for orienting said tool with said side-pocket landing nipple to direct a well tool supported from said kick-over tool into said landing nipple.

12. A well device for controlling fluid communication between the interior and exterior of a well tubing comprising: a side-pocket mandrel body having means at each end for connection into said well tubing and a longitudinal open bore aligned with said tubing when said mandrel body is connected into said tubing; said mandrel body having a side-pocket chamber extending longitudinally therein in integral relationship with said open bore and laterally offset from said bore; a side-pocket landing nipple formed within said body mandrel along said side-pocket chamber and having a longitudinal bore substantially parallel with said open bore through said body mandrel; said body mandrel having an outside wall along said side-pocket landing nipple provided with side port means opening into said bore of said landing nipple for communicating space around said body mandrel with said bore of said landing nipple; a sliding sleeve valve slidably positioned within said bore of said side-pocket landing nipple and movable therein between a first closed position and a second open position, said sleeve valve having side port means aligned with said side port means in said body mandrel when said sleeve valve is at said second open position; ring seal means on said sleeve valve sealing between the wall surface defining said bore through said landing nipple on opposite sides of said port means in said sleeve valve; locking collet means including a plurality of circumferentially spaced collet fingers on said sliding sleeve valve for releasably locking said sleeve valve at said first closed position in said landing nipple, said locking collet fingers having external and internal locking bosses thereon; said landing nipple having an internal annular locking recess for receiving said external locking bosses on said collet fingers to releasably lock said sliding sleeve valve at said first closed position; stop means having a stop shoulder engaged in said side-pocket landing nipple for limiting movement of said sliding sleeve valve at said second open position; and said side-pocket landing nipple having a stop shoulder formed around the bore therethrough spaced from said sliding sleeve valve for engagement by locking means on a well tool positioned through said landing nipple and sliding sleeve valve when said well tool is locked therein and holding said sliding sleeve valve at said second open position; and stop shoulder means in said sliding sleeve valve for supporting said well tool in said sleeve valve.

13. A well device in accordance with claim 12 including an orientation sleeve in said body mandrel around said open bore therethrough and spaced from said side-pocket landing nipple, said orientation sleeve having an orientation slot and a spiral guide surface leading to said slot for orienting a kick-over tool supporting a well tool for installation in said side-pocket landing nipple.

14. A well device in accordance with claim 13 including laterally spaced guide lugs in said body mandrel along said side-pocket chamber therein spaced from said side-pocket landing nipple for guiding a well tool into said bore of said landing nipple.

15. A well device for controlling communication between the interior and exterior of a tubing string comprising: a body mandrel connectible at opposite ends into said tubing string and having a chamber therein defined by a main open bore portion in alignment with the bore of said tubing string when said body mandrel is connected with said tubing string and a laterally displaced side-pocket portion extending longitudinally along said main open bore portion; a side-pocket landing nipple secured along said chamber within said body mandrel and having an open bore therethrough opening at opposite ends into said side-pocket portion of said chamber; said body mandrel having a side-wall provided with port means opening into said bore of said landing nipple; and a sliding sleeve valve in said landing nipple for controlling flow through said side port into said bore of said nipple, said sliding sleeve valve having means for releasably locking said valve at a closed position and means for releasably latching said valve with a flow control device positioned in said sleeve valve, said releasable locking means and said releasable latching means coacting with said flow control device to move said sliding sleeve valve from a closed position to an open position responsive to insertion of said flow control device into said sliding sleeve valve and to release said flow control device from said sliding sleeve valve only responsive to movement of said sliding sleeve valve back to a closed position.

16. A method of controlling communication in a well between the interior and exterior of a well tubing including a side-pocket mandrel having a side-pocket landing nipple provided with a sliding sleeve valve for controlling flow through side port means in said mandrel leading from said exterior of said tubing into said landing nipple comprising the steps of: inserting a well tool into said side-pocket landing nipple through said well tubing; engaging said sliding sleeve valve with said well tool releasing said sleeve valve from a closed locked relationship in said landing nipple; latching said sleeve valve with said well tool upon release of said valve for movement in said landing nipple; and moving said sleeve valve by means of said well tool to an open position at which fluid communication is established through said side ports in said body mandrel into said landing nipple through said sleeve valve.

17. A method in accordance with claim 16 wherein said well tool is a flow control device and including the steps of flowing said well and controlling said flowing by means of said flow control device.

18. A method in accordance with claim 16 including the step of thereafter closing said sliding sleeve valve by moving said well tool in a direction to force said sliding sleeve valve from an open position back to a closed position; releasing said well tool from said sliding sleeve valve; and locking said sliding sleeve valve at said closed position in said landing nipple upon release of said well tool from said sliding sleeve valve.

19. A method in accordance with claim 18 wherein said well tool is engaged with said sliding sleeve valve forcing said well tool against a stop shoulder provided in said sliding sleeve valve, said sliding sleeve valve is released from said landing nipple and latched with said well tool by camming collet finger heads on said sliding sleeve valve inwardly from a locking recess in said landing nipple into a latching recess around said well tool, said sliding sleeve valve is locked at an open position in said landing nipple by engagement of locking means on said well tool with a locking shoulder in said landing nipple, and said sliding sleeve valve is returned to a closed position by withdrawing said well tool from said landing nipple to force said sliding sleeve valve to said closed position by means of said collet finger heads which are expanded into said locking recess in said landing nipple to lock said sliding sleeve valve at said closed position while expanding said collet finger heads out of said latching recess around said well tool to release said well tool for withdrawal from said landing nipple.

* * * * *